US008647239B1

(12) United States Patent
Sokolovas et al.

(10) Patent No.: US 8,647,239 B1
(45) Date of Patent: Feb. 11, 2014

(54) VERTICAL SWIM TRAINER

(71) Applicants: Genadijus Sokolovas, Colorado Springs, CO (US); Birute Sokolovas, Colorado Springs, CO (US); Nikiforas Sokolovas, Kaunas (LI); David W. Wilhide, Colorado Springs, CO (US)

(72) Inventors: Genadijus Sokolovas, Colorado Springs, CO (US); Birute Sokolovas, Colorado Springs, CO (US); Nikiforas Sokolovas, Kaunas (LI); David W. Wilhide, Colorado Springs, CO (US)

( * ) Notice: Subject to any disclaimer, the term of this patent is extended or adjusted under 35 U.S.C. 154(b) by 0 days.

(21) Appl. No.: 13/655,022

(22) Filed: Oct. 18, 2012

(51) Int. Cl.
*A63B 69/10* (2006.01)

(52) U.S. Cl.
USPC ..... 482/56; 482/55

(58) Field of Classification Search
USPC ..... 482/55–56, 62–63, 72, 121–123, 482/126–127, 129–130, 133, 135–136, 142, 482/148
See application file for complete search history.

(56) References Cited

U.S. PATENT DOCUMENTS

| | | | | | |
|---|---|---|---|---|---|
| 4,830,363 | A * | 5/1989 | Kennedy | 482/56 |
| 4,948,119 | A * | 8/1990 | Robertson, Jr. | 482/56 |
| 5,147,265 | A * | 9/1992 | Pauls et al. | 482/119 |
| 5,201,694 | A * | 4/1993 | Zappel | 482/133 |
| 5,352,176 | A * | 10/1994 | Huang | 482/146 |
| 5,366,426 | A * | 11/1994 | Glavin | 482/56 |
| 5,941,807 | A * | 8/1999 | Cassidy et al. | 482/146 |
| 6,267,711 | B1 * | 7/2001 | Hinds | 482/121 |
| 6,319,179 | B1 * | 11/2001 | Hinds | 482/121 |
| 6,669,609 | B2 * | 12/2003 | Gerschefske et al. | 482/123 |
| 7,226,402 | B1 * | 6/2007 | Joya | 482/121 |
| 7,250,021 | B2 * | 7/2007 | Leight | 482/116 |
| 7,482,050 | B2 * | 1/2009 | Olson | 428/123 |
| 7,524,272 | B2 * | 4/2009 | Bruck et al. | 482/127 |
| 7,740,563 | B2 * | 6/2010 | Dalebout et al. | 482/52 |
| 7,846,075 | B2 * | 12/2010 | Ish, III | 482/92 |
| 2001/0046928 | A1 * | 11/2001 | Nette | 482/55 |
| 2003/0109365 | A1 * | 6/2003 | Smith | 482/146 |
| 2004/0198571 | A1 * | 10/2004 | Howell et al. | 482/123 |
| 2005/0049123 | A1 * | 3/2005 | Dalebout et al. | 482/142 |
| 2005/0143230 | A1 * | 6/2005 | Dalebout et al. | 482/121 |
| 2005/0272577 | A1 * | 12/2005 | Olson et al. | 482/123 |
| 2006/0035768 | A1 * | 2/2006 | Kowallis et al. | 482/123 |
| 2006/0189462 | A1 * | 8/2006 | Pearson et al. | 482/142 |
| 2006/0258520 | A1 * | 11/2006 | Bowser | 482/121 |
| 2006/0287170 | A1 * | 12/2006 | Gerschefske et al. | 482/94 |
| 2007/0099780 | A1 * | 5/2007 | Bowser | 482/148 |
| 2007/0207902 | A1 * | 9/2007 | Tiahrt | 482/72 |
| 2007/0270293 | A1 * | 11/2007 | Zhuang | 482/123 |
| 2008/0020912 | A1 * | 1/2008 | Dalebout et al. | 482/129 |
| 2008/0090708 | A1 * | 4/2008 | Balaker et al. | 482/138 |
| 2008/0234117 | A1 * | 9/2008 | Clark et al. | 482/142 |
| 2009/0215596 | A1 * | 8/2009 | Obermaier | 482/142 |
| 2009/0215597 | A1 * | 8/2009 | Fernandez | 482/146 |
| 2009/0270230 | A1 * | 10/2009 | Piaget et al. | 482/53 |
| 2010/0130338 | A1 * | 5/2010 | Wehrell | 482/124 |
| 2010/0267526 | A1 * | 10/2010 | Baschnagel | 482/86 |
| 2010/0267530 | A1 * | 10/2010 | Gerschefske et al. | 482/130 |
| 2010/0298106 | A1 * | 11/2010 | Bowser | 482/148 |

* cited by examiner

*Primary Examiner* — Loan Thanh
*Assistant Examiner* — Andrew S Lo
(74) *Attorney, Agent, or Firm* — G. F. Gallinger

(57) ABSTRACT

A swim trainer comprising: a base; an upright member extending from the base; two arms each carried by the upright member and terminating with an end pulley; two pull cords each having one end connected to a hand pull, extending from the hand pull over the end pulley, a second pulley positioned adjacent to the upright member, and then along the upright member; a rotatable shaft positioned adjacent to the base; a loading mechanism, connected to the shaft, to resist rotation and unwinding of the cord around the shaft; a clutch assembly positioned on the shaft arranged to rotate the shaft when the handle is pulled down and otherwise spin freely; a rewind bias means to rewind the cord around the shaft; and, a tipping and/or rotating balance platform assembly, seated on the base, for the swimmer to stand on, when pulling the hand pull.

11 Claims, 3 Drawing Sheets

VERTICAL SWIM TRAINER

FIELD OF THE INVENTION

This invention relates to strength, power, and endurance training apparatuses for swimming. More particularly this invention relates to an apparatus which not only strengthens the arms and wrists, as well as providing feedback to the user on optimal hand position and direction of motion, but which additionally strengthens the torso and core muscles used in swimming.

BACKGROUND OF THE INVENTION

The first inventor is a physiologist and swim coach employed by the Olympic Training Center. Most swimming exercise training apparatuses fail to combine 1) a singular motion along a longitudinal axis of the body (precisely the most efficient movement which results in a forward propulsion of the body in the water) and, 2) utilization and strengthening of the core muscles in the torso (which connect the arms to the body) which are crucial to maximize strength and efficiency of a swim stroke. With respect to point 1), arm movement which is along a longitudinal axis of the body is the most efficient movement which results in forward movement of the body through the water. Not only is proper arm movement required, but additionally the palms of the hands result in maximal forward propulsion of the body when they are maintained in a plane which is perpendicular to the longitudinal axis of the body. Swimmers who expend energy pushing water in a direction other than longitudinally to the body wholly waste that energy. Wasted energy not only includes pushing water down or to the side, but additionally excessive rotation of the torso of the body in the water. A natural rotation of the body facilitates a longer stroke length and maximum power. The rotation of the trunk and shoulder, particularly at the beginning of the stroke facilitates increased reach and a more powerful stroke. With respect to point 2), it should be noted that maintenance of alignment and rigidity of the body are also critical to maximize speed. All fast boats are rigid. Bending and flexing of the body while swimming results poorer penetration of the water and in speed loss. The body, unlike a boat, naturally flexes and bends when maximal pull is exerted with a single arm. This results in speed loss. The swimmer must train himself to maintain his body aligned and rigid.

OBJECTS OF THE INVENTION

It is an object of this invention to disclose a vertical swim trainer which requires and measures work exerted only in a direction which is longitudinal to the body. It is an object of this invention to disclose a vertical swim trainer which ensures that the core torso region of the body is not only strengthened but additionally maintained in a rigid aligned position and utilized in the arm stroke by connecting with arm muscles. It is yet a further object of this invention to disclose a swim training apparatus having a balance platform having adjustable stability. Less experienced swimmers require a more stable balance platform. As a swimmer attains greater torso strength and rigidity, he can benefit by adjustably reducing the stability of the balance platform to thereby attain further torso strength and rigidity. It is yet a further object of this invention to disclose a swim training apparatus which maintains the hands in a position generally perpendicular to the body and indicates when the hands are not in a position generally perpendicular to the body.

One aspect of this invention provides for a vertical swim trainer comprising: a) a base; b) an upright member attached to and extending upwardly from the base; c) two arms each carried by a top portion of the upright member and terminating with an end pulley positioned above a front portion of a swimmer's shoulder when the swimmer is standing on the base; d) two pull cords each having one end connected to a hand pull, having a central portion extending from the hand pull over the end pulley, then over a second pulley positioned adjacent to the arm and the upright member, and then down along the upright member where said pull cords are wound around; e) a rotatable shaft positioned adjacent to a lower portion of the upright member and the base, having its axis generally perpendicular to the unwound cord to accommodate the cord being wound therearound; f) a loading mechanism, connected to the shaft, to resist rotation and unwinding of the cord around the shaft when the hand pull is pulled down; g) a clutch assembly positioned on the shaft arranged to rotate the shaft when the hand pull is pulled down and to spin freely when the hand pull is returned to its upper initial position; h) a rewind bias means to rewind the cord around the shaft, and concurrently pull the hand pull up and back to the initial position after it has been pulled down to a lower position and released; and, i) a tipping and/or rotating balance platform assembly, seated on the base, for the swimmer to stand on, when pulling the hand pull. The swimmer is thereby required to utilize the core muscles in the body when pulling on the handle to maintain body alignment and rigidity, thus better developing both arm and torso strength required for fast and efficient swimming.

In a preferred aspect of this invention the loading mechanism is an eddy current resistance comprising a rotating magnet wheel variably spaced from a stationary eddy current disc, so that induced eddy currents in the stationary eddy current disc which oppose angular rotation, can be selectively varied by varying the spacing between the rotating magnet disc and the stationary eddy current disc.

In yet another aspect of the invention the balance platform is has a tipping control means to vary and control the amount of tipping.

In yet another aspect of the invention the balance platform has a rotation control means which provides variable bias to limit and control the amount of rotation.

Various other objects, advantages and features of this invention will become apparent to those skilled in the art from the following description in conjunction with the accompanying drawings.

FIGURES OF THE INVENTION

Figure 7:
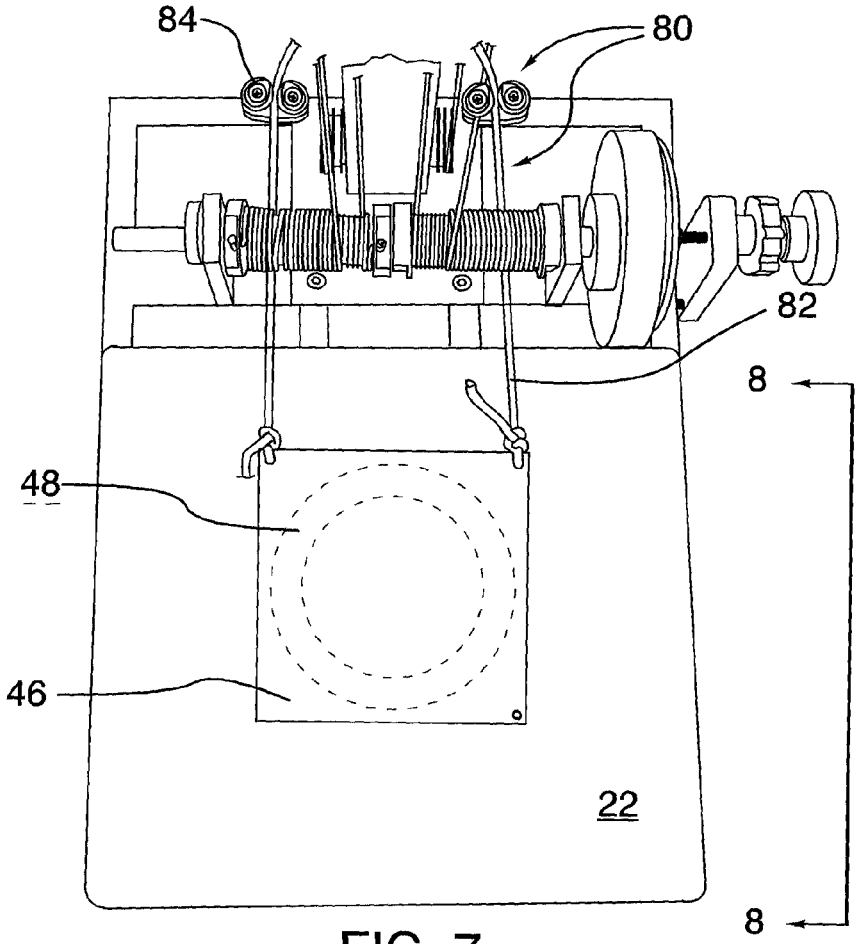

FIG. 7 is a plan view of the base taken along line 7-7 on FIG. 7. Herein a square plate has a selected bias to maintain the swimmer in a centered forward position facing directly forward. A rotation control means comprises elasticized cords having first ends tied to adjacent rear corner portions of the square plate, and second ends held by releasable adjustable eccentric clamps, attached to a rear side portion of the base, to thereby adjust cord tension and control the amount of bias on the square plate to the central forward position.

Figure 8:
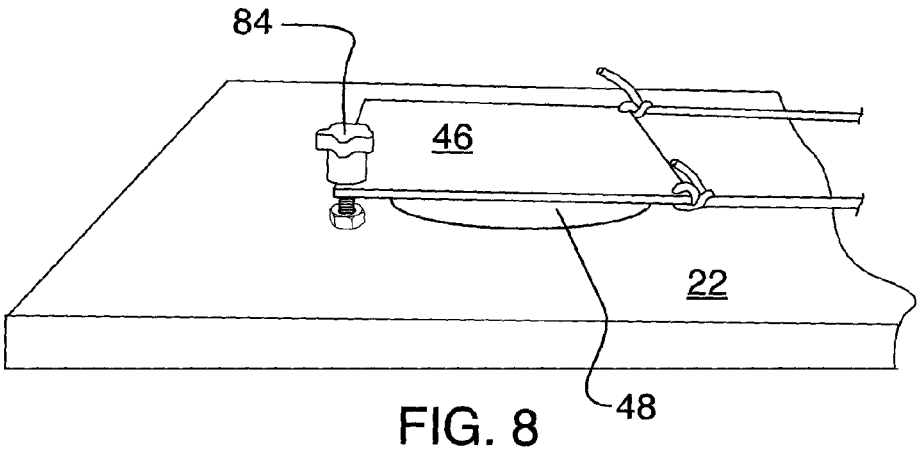

FIG. 8 is a partial elevation as viewed along line 8-8 in FIG. 7, showing the base and square plate, and further comprising a lock screw to non-rotatably maintain the square plate in a central forward position for a swimmer inexperienced on the vertical swim trainer.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Figure 1:
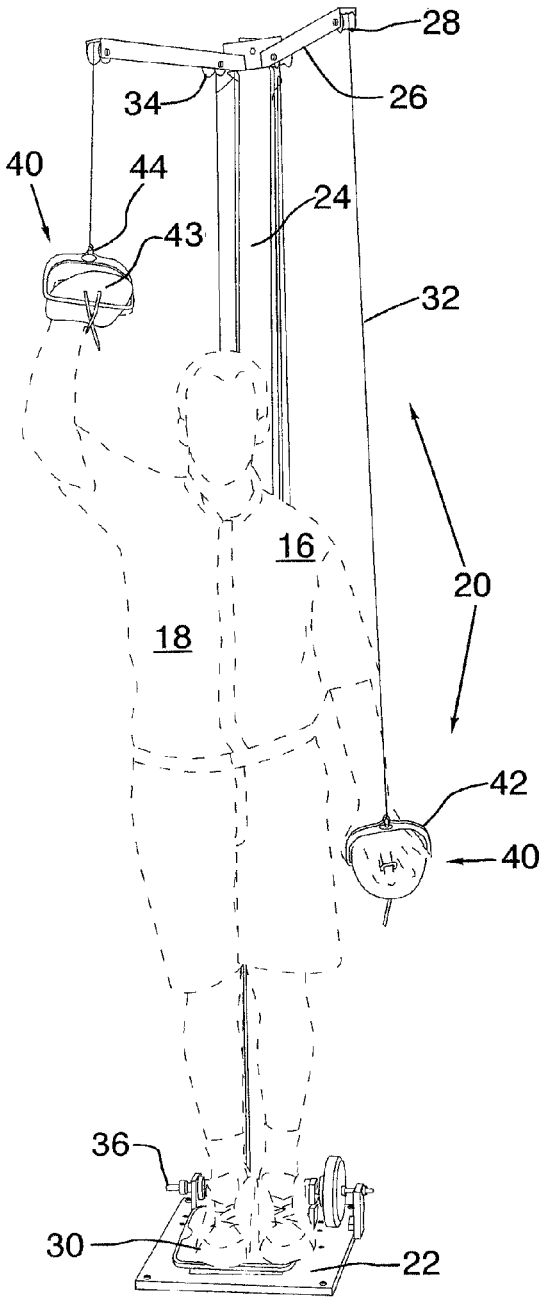
FIG. 1 is a perspective view of the vertical swim trainer being used by a swimmer. The swimmer is balanced on a balance platform assembly.
Figure 2:
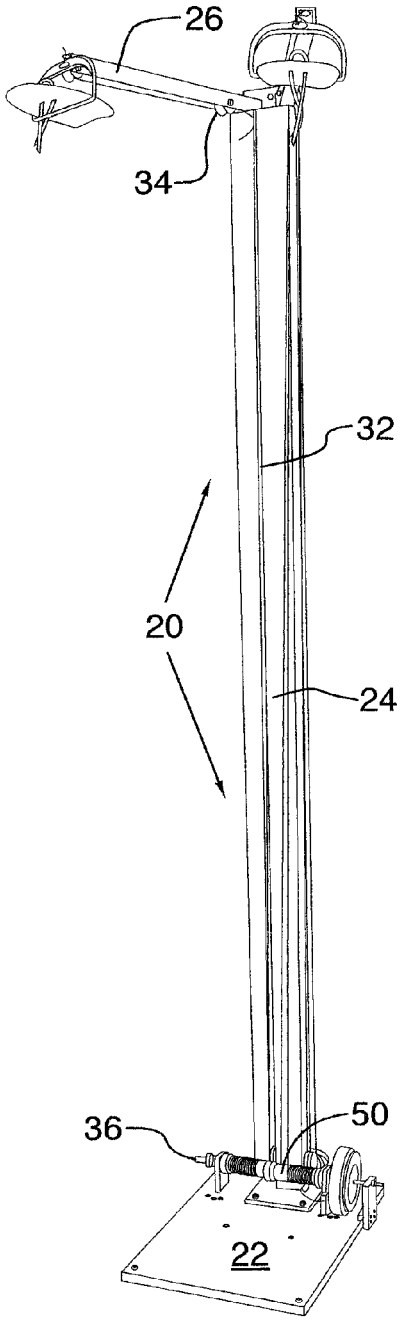
FIG. 2 is a perspective view of the vertical swim trainer shown in FIG. 1 in an idle position. The platform assembly is removed therefrom.
Figure 3:
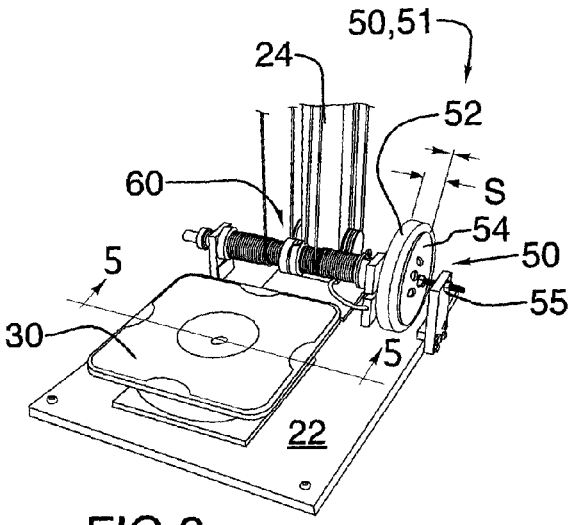
FIG. 3 is an enlarged perspective view of the base of the vertical swim trainer shown in FIG. 1.

Turning now to the drawings and more particularly to FIG. 1 which is a perspective view of the vertical swim trainer 20 being used by a swimmer 18. The swimmer 18 is standing balanced on a platform assembly 30. FIG. 2 is a perspective view of the vertical swim trainer 20 shown in FIG. 1 in an idle position. The balance platform assembly 30 is removed therefrom. FIG. 3 is an enlarged perspective view of the base 22 of the vertical swim trainer shown in FIG. 1. Most generally, a vertical swim trainer 20 comprises: a) a base 22; b) an upright member 24 attached to and extending upwardly from the base 22; c) two arms 26 each carried by a top portion of the upright member 24 and terminating with an end pulley 28 positioned above a front portion of a swimmer's shoulder 16 when the swimmer 18 is standing on the base 22; d) two pull cords 32 each having one end connected to a hand pull 40, having a central portion extending from the hand pull 40 over the end pulley 28, then over a second pulley 34 positioned adjacent to the arm 26 and the upright member 24, and then down along the upright member 24 where said pull cords 32 are wound around; e) a rotatable shaft 36 positioned adjacent to a lower portion of the upright member 24 and the base 22, having its axis generally perpendicular to the unwound pull cord 32 to accommodate the pull cord 32 being wound therearound; f) a loading mechanism 50, connected to the shaft 36, to resist rotation and unwinding of the cord 32 around the shaft 36 when the hand pull 40 is pulled down; g) a clutch assembly 50 arranged to rotate the shaft 36 when the hand pull 40 is pulled down and to spin freely when the hand pull 40 is returned to its upper initial position; h) a rewind bias means 60 to rewind the pull cord 32 around the shaft 36, and concurrently pull the hand pull 40 up and back to the initial position after it has been pulled down to a lower position and released; and, i) a tipping and/or rotating balance platform assembly 30, seated on the base 22, for the swimmer 18 to stand on, when pulling the hand pull 40. The swimmer 18 is thereby required to utilize the core muscles in the body when pulling on the hand pull 40 to maintain body alignment and rigidity, thus better developing both arm and torso strength required for fast and efficient swimming.

FIG. 3 is an enlarged perspective view of the base 22, best shows the loading mechanism 50. Most preferably the loading mechanism 50 comprises an eddy current resistance 51 having a magnet wheel 52 variably spaced S from an eddy current disc 54, one of which rotates, and one of which is stationary. Induced eddy currents in the eddy current disc 52 which oppose angular rotation, can be selectively varied by varying the spacing S between the magnet disc 54 and the eddy current disc 52. In FIG. 3 the magnet wheel 52 rotates, and the eddy current disc 54 is stationary. Eddy current disc 54 can be moved on threaded stud 55, to vary the space S between the magnet wheel 52 and the eddy current disc 54. When the loading mechanism 50 is an eddy current resistance 51 the load is inversely proportional to the square of the distance between the rotating magnet disc 54 and the stationary eddy current disc 52. (It is also noted that the load is directly proportional to the velocity of the rotating magnet disc 54.) Alternatively, the loading mechanism could comprise a fan (not shown). With a fan the load is directly proportional to the square of the speed of the fan (not shown).

Figure 5:
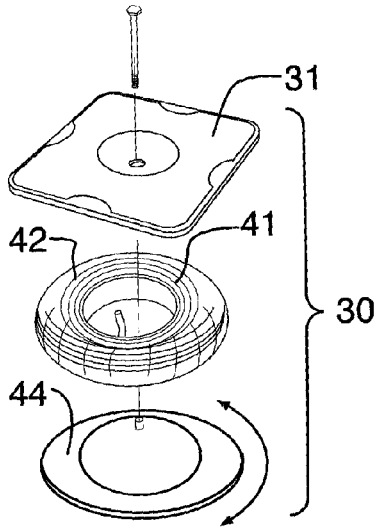
FIG. 5 is a cross sectional view of the balance platform assembly taken along line 5-5 in FIG. 3.
Figure 5:
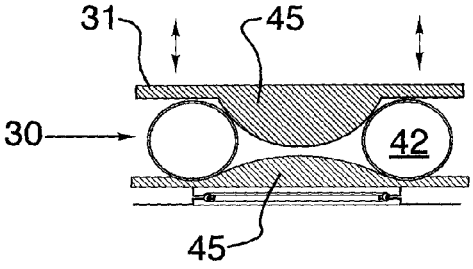
Figure 4:
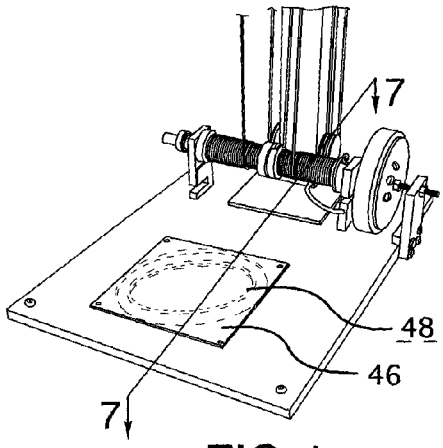
FIG. 4 is an exploded view of the balance platform assembly shown in FIG. 3.

FIG. 4 is an exploded view of the balance platform assembly 30 shown in FIG. 3. Most preferably the platform assembly 30, in addition to tipping is rotatable. Most preferably, the platform 30 comprises an upper surface 31, an inflated wheel tube 42, and a rotating disc 44, which is seated on a square plate 46 all of which are rotatably carried on a circular bearing assembly 48. Most preferably a tipping control means 41 comprises a wheel tube 42, pressurized to an optimal pressure to regulate tipping. It is further noted that the regulation of stability of the platform is most important. Less experienced swimmers require a more stable platform (less tipping and less rotation). With respect to tipping, this can be achieved by increasing air pressure in the wheel tube 42. More experienced swimmers 18 can benefit from, and continue to improve rigidity in the body position by exercising on a less stable platform (more tipping and more rotation). With respect to tipping, this can be achieved by reducing pressure in the wheel tube 42. FIG. 5 is a cross sectional view of the balance platform assembly taken along line 5-5 in FIG. 3. When the body of the swimmer 18 is not maintained in a rigid and balanced position on the platform assembly 30, the wheel tube 42 compresses on one side and the upper surface 31 tips. FIGS. 4, and 5 also show the use of a central upwardly extending, and downwardly extending portions 45 which extend into the central opening within the wheel tube 42 to ensure maintenance of overall centered position of the balance platform assembly 30.

Figure 6:
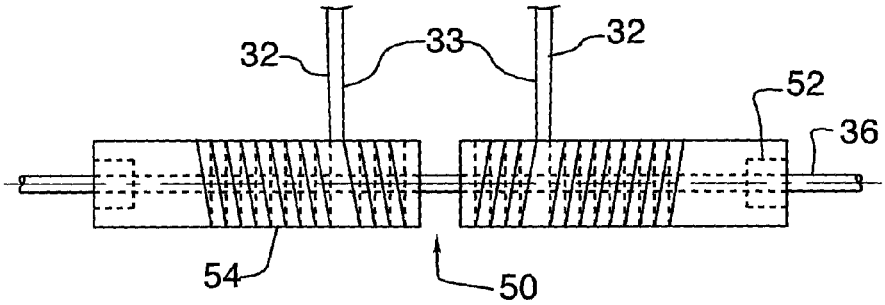
FIG. 6 is an enlarged cross sectional schematic view of an alternative embodiment of the cord winding sleeve and the one way clutch positioned on the shaft.

FIG. 6 is an enlarged cross sectional schematic view of an alternative embodiment of the cord winding spool 54 and the one way clutch assembly 50 positioned in the spool 54 on the shaft 36. Most preferably the clutch assembly 50 comprises a one way clutch insert 52 which is positioned within a cord winding spool 54, all of which are pressed on the shaft 36, so that the spool 54 can rotate in two directions, only one of which rotates the shaft 36. Most preferably the rewind bias means 60 comprises an elasticized rewind cord 33 which is wound on the cord winding spool in a direction which is opposite to the direction which the pull cords are wound when the hand pull 40 is pulled down, and which rewinds the spool 54, rewinding the pull cords 32 on the sleeve, and upwardly biases the hand pull 40, when the hand pull is not held in a lower position. As shown in FIG. 6 there are two spools 54, one for each pull cord 32, and the rewind cord 33 associated with its hand pull 40. Pulling on the hand pull 40 unwinds the pull cord 32 from the spool 54, and concurrently winds rewind cord 33 associated with the same hand pull 40 onto the spool 54. The clutch assembly 50 used was part RCB-101416, a roller clutch and bearing assembly, purchased from the Timken Company in Canton, Ohio.

FIG. 7 is a plan view of the base taken along line 7-7 on FIG. 4. FIG. 7 shows a square plate 46 which is fastened to the rotatable bearing assembly 48, which in turn is fastened to the base 22. The square plate 46 has a selected bias to a centered forward position which biases and helps to maintain the swimmer 18 in a position facing directly forward. A rotation control means 80 provides variable bias to limit and control the amount of rotation. As a swimmer becomes more skilled and increasingly uses, and strengthens his torso and shoulder muscles to limit the rotation of his body, the bias to the position facing directly forward may be decreased. Most preferably comprises the rotation control means 80 comprises elasticized cords 82 having first ends tied to adjacent rear corner portions of the square plate 22, and second ends held by releasable adjustable eccentric clamps 84, attached to a rear side portion of the base, to thereby adjust elasticized cord 82 tension and thereby control the amount of bias on the square plate to the central forward position.

FIG. 8 is a partial elevation as viewed along line 8-8 in FIG. 7, showing the base 22 and square plate 46, and further comprising a removable lock screw 84 to non-rotatably maintain the square plate 22 in a central forward position for a swimmer 18, inexperienced using the vertical swim trainer 20. Even when the tipping balance platform assembly 30 is maximally biased to the central forward position, the combination of both a rotating and tipping balance platform 30 together may be initially too difficult for even an experienced swimmer 18. Accordingly, the removable lock screw 18 is provided to prevent all balance platform 30 rotation so that the swimmer 18 may become skilled in balancing on the tipping balance platform 30 before having to additionally deal with balance platform 30 rotation.

Looking again at FIGS. 1 and 2, the hand pull 40 comprises a horizontal planar portion 43 held on opposite sides by an inverted yolk 44 which is centrally attached to the pull cord 32, thereby enabling a swimmer to visually ensure that the palm of his hand when seated and pulling on the planar portion 43 is correctly aligned, perpendicular to the pull cord 32 (and a longitudinal axis of the swimmer 18).

While the invention has been described with preferred specific embodiments thereof, it will be understood that this description is intended to illustrate and not to limit the scope of the invention, which is defined by the following claims.

We claim:

1. A vertical swim trainer comprising:

a base;

an upright member attached to and extending upwardly from the base;

two arms each carried by a top portion of the upright member and terminating with an end pulley positioned above a front portion of a swimmer's shoulder when the swimmer is standing on the base;

two pull cords each having one end connected to a hand pull, having a central portion extending from the hand pull over the end pulley, then over a second pulley positioned adjacent to the arm and the upright member, and then down along the upright member;

a rotatable shaft positioned adjacent to a lower portion of the upright member and the base, having its axis generally perpendicular to the unwound pull cord to accommodate the pull cords being wound therearound;

a loading mechanism, connected to the shaft, to resist rotation and unwinding of the cord around the shaft when the hand pull is pulled down;

a clutch assembly positioned on the shaft arranged to rotate the shaft when the hand pull is pulled down and to spin freely when the hand pull is returned to its upper initial position;

a rewind bias means to rewind the cord around the shaft, and concurrently pull the hand pull up and back to the initial position after it has been pulled down to a lower position and released; and, a tipping and/or rotating balance platform assembly, seated on the base, for the swimmer to stand on, when pulling the hand pull;

thereby requiring the swimmer to utilize the core muscles in the body when pulling on the handle to maintain body alignment and rigidity, thus better developing both arm and torso strength required for fast and efficient swimming.

2. A vertical swim trainer as in claim 1, wherein the balance platform assembly tips and comprises a tipping control means to vary and control the amount of tipping.

3. A vertical swim trainer as in claim 2, wherein the tipping control means comprises an inflated wheel tube, positioned on a rotating disc, said wheel tube pressurized to regulate tipping.

4. A vertical swim trainer as in claim 1, wherein the balance platform assembly is rotatable and comprises a rotation control means which provides variable bias to limit and control the amount of rotation.

5. A vertical swim trainer as in claim 4, wherein the rotation control means controllably biases the rotating platform to a central forward position so that a swimmer standing thereon would tend to generally face forward.

6. A vertical swim trainer as in claim 5, wherein rotation control means comprises a square plate, rotatably attached to a rotating bearing assembly, and an elasticized cord having first ends tied to adjacent rear corner portions of a square plate, and second ends releasably held by eccentric clamps, attached to a rear portion of the base, so that the tension of the elasticized cords may be set thereby determining the amount of central forward bias of the balance platform.

7. A vertical swim trainer as in claim 4, wherein the balance platform assembly both tips and rotates, and wherein the balance platform assembly further comprises a removable hand screw, extending through a rotatable square plate and then into the base, to maintain the square plate in a non-rotatable central forward position, so that a swimmer standing thereon would consistently face forward, to thereby allow an inexperienced swimmer to successfully balance on a tipping platform before additionally having to cope with rotation of the balance platform.

8. A vertical swim trainer as in claim 1, wherein the loading mechanism is an eddy current resistance comprising a magnet wheel variably spaced from an eddy current disc, one of which rotates, and one of which is stationary; so that induced eddy currents in the eddy current disc which oppose angular rotation, can be selectively varied by varying the spacing between the magnet wheel and the eddy current disc.

9. A vertical swim trainer as in claim 1, wherein the clutch assembly comprises a one way clutch insert which is positioned within a cord winding sleeve, all of which are pressed on the shaft, so that the sleeve can rotate in two directions, only one of which rotates the shaft.

10. A vertical swim trainer as in claim 9, wherein the rewind bias means comprises an elasticized cord which is wound on the cord winding sleeve when the handle is pulled down, which rewinds the sleeve, rewinding the pull cord on the sleeve, and upwardly biases the handle pull, when the handle pull is not held in the lower position.

11. A vertical swim trainer as in claim 4, wherein the hand pull comprises a horizontal planar portion held on opposite sides by an inverted yolk which is centrally attached to the pull cord, thereby enabling a swimmer to visually ensure that the palm of his hand when seated and pulling on the planar portion is correctly aligned, perpendicular to the pull cord.

* * * * *